United States Patent [19]

Goloff

[11] 3,963,388

[45] June 15, 1976

[54] UNITARY APEX SEAL ASSEMBLY

[75] Inventor: Alexander Goloff, East Peoria, Ill.

[73] Assignee: Caterpillar Tractor Co., Peoria, Ill.

[22] Filed: Jan. 20, 1975

[21] Appl. No.: 542,532

[52] U.S. Cl. ..... 418/121

[51] Int. Cl.[2] ..... F01C 19/10

[58] Field of Search..... 418/61 A, 112, 113, 418/120–122, 246, 248; 277/81

[56] References Cited

UNITED STATES PATENTS

| | | | |
|---|---|---|---|
| 133,159 | 11/1872 | LaFrance | 418/113 |
| 3,194,489 | 7/1965 | Frenzel | 418/122 |
| 3,286,912 | 11/1966 | Tado | 418/120 |
| 3,485,217 | 12/1969 | Irgens | 418/121 |
| 3,932,074 | 1/1976 | Morris | 418/225 |

FOREIGN PATENTS OR APPLICATIONS

| | | | |
|---|---|---|---|
| 1,185,875 | 1/1965 | Germany | 418/121 |
| 1,135,708 | 8/1962 | Germany | 418/121 |
| 1,210,278 | 2/1966 | Germany | 418/113 |
| 1,526,385 | 4/1970 | Germany | 418/122 |

*Primary Examiner*—C. J. Husar

*Attorney, Agent, or Firm*—Wegner, Stellman, McCord, Wiles & Wood

[57] ABSTRACT

A unitary apex seal assembly for rotary engines. The assembly includes a pair of spaced bolts each adapted to engage a respective side wall of the rotor-containing chamber of the engine. Each bolt has a generally radially extending slot, and each slot includes an enlarged seal-retaining portion. A spring is interposed between the bolts and connected to both, and is further adapted to urge the bolts away from each other when installed in a rotary engine. An apex seal is received in the slots of both of the bolts, and includes an enlarged section within the enlarged seal-retaining portion of each of the slots. The seal is provided with a raised surface located between the bolts for precluding substantial axial relative movement between the bolts and the seal, so that the seal and appurtenances can be installed within a rotor as a single assembly.

5 Claims, 3 Drawing Figures

UNITARY APEX SEAL ASSEMBLY

BACKGROUND OF THE INVENTION

This invention relates to rotary engines and, more particularly, to apex seals and apex seal assemblies for such engines.

Prior art of possible relevance includes U.S. Pat. Nos. 3,194,489 to Frenzel and 3,485,217 to Irgens.

While the basic construction and operational principles of rotary engines such as so-called "Wankel" engines have long been known, they have not yet met with any appreciable commercial utilization. A large factor in the absence of appreciable commercialization is the inability to provide reliable, long-lived seals in the engines. This is particularly true of apex seals. Consequently, it is desirable to increase the reliability of apex seals.

A typical rotary engine employing apex seals employs a multiplicity of components in each seal, all of which are typically individually assembled into the rotor. The number of parts, coupled with individual assembly, not only raises the cost of the engine, but reduces the reliability of the product. As will be appreciated, when the customary six components, usually the seal itself, two bolts and three biasing springs, are all individually assembled into the rotor, there is a distinct possibility that one or more of the parts may be omitted, with the result that in use, the defective seal will soon fail.

SUMMARY OF THE INVENTION

It is the principal object of the invention to provide a new and improved apex seal for rotary engines. More specifically, it is an object of the invention to provide a unitary seal assembly which may be easily installed in rotary engines as a single unit to avoid reliability problems caused by parts being omitted during installation.

The exemplary embodiment of the invention achieves the foregoing objects in a structure comprising a pair of spaced bolts, each having a generally radially extending slot. Each slot includes an enlarged seal-retaining portion.

Resilient means are interposed between the bolts and interconnect the two to form an assembly. The resilient means is adapted to urge the bolts away from each other when installed in a rotary engine to provide the requisite sealing engagement of the bolts with the side walls of the rotor chamber. Typically, a helical spring will be employed as the resilient means.

An apex seal is received in the slots of both of the bolts, and has an enlarged section within the enlarged seal-retaining portion of each of the slots so as to preclude the seal from falling out of the slots radially.

Means are also provided for precluding substantial lateral relative movement between the bolts and the seal so that the seal will be retained within the assembly.

According to a highly preferred embodiment of the invention, the means precluding substantial lateral relative movement comprises a projection on a side surface of the seal, and located between the bolts in such a way so as to engage an inner end of either to preclude substantial lateral movement.

The invention also contemplates that the sum of the length of the bolts be only somewhat less than the width of the rotor with which the seal assembly is to be used, thereby allowing the rotor to be more easily fabricated in terms of allowing a uniform slot at each apex for each seal assembly.

In some instances, it is desirable that a pilot pin be employed to further interconnect the two bolts.

Other objects and advantages of the invention will become apparent from the following specification taken in conjunction with the accompanying drawings.

DESCRIPTION OF THE PREFERRED EMBODIMENT

Figure 2:
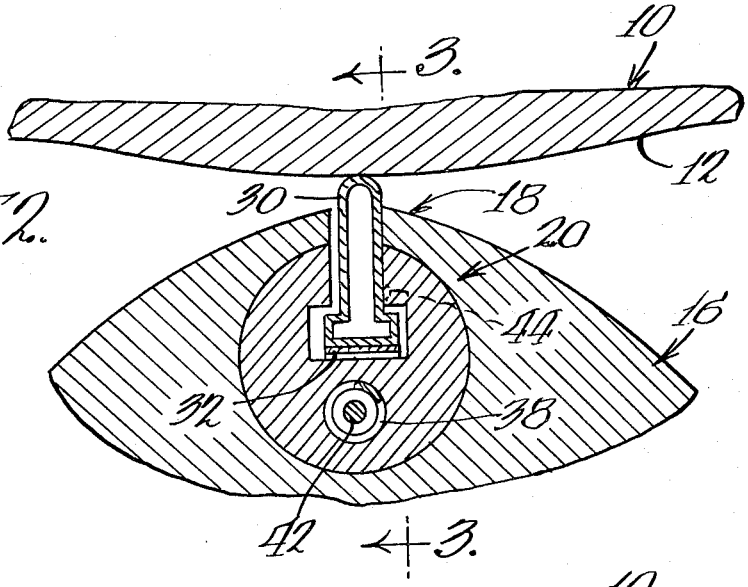
FIG. 2 is a fragmentary, somewhat schematic, sectional view of a rotary engine employing the seal assembly.
Figure 3:
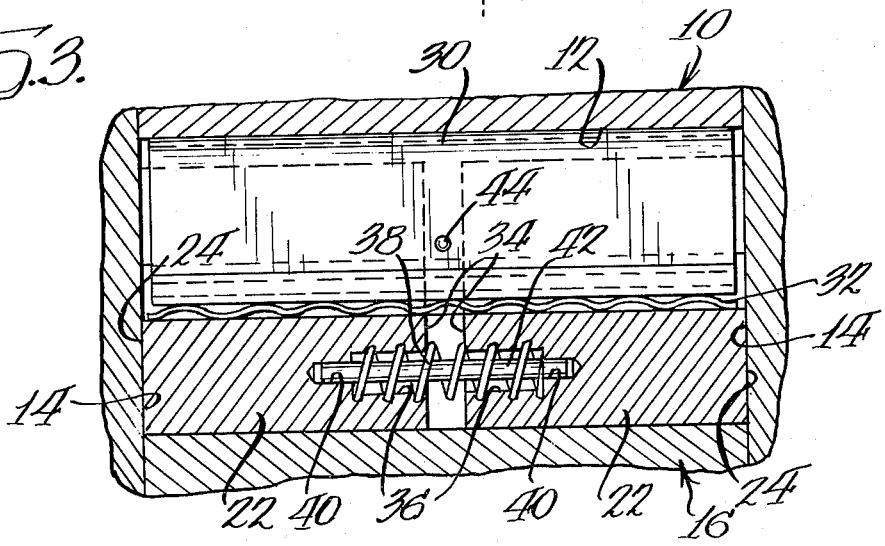
FIG. 3 is a section taken approximately along the line 3—3 of FIG. 2.

An exemplary embodiment of a seal assembly made according to the invention is illustrated in the drawings, and with reference specifically to FIG. 2, is employed in a rotary engine having a housing, generally designated 10, provided with an interior wall 12. As seen in FIG. 3, the housing includes opposed side walls 14. A rotor, generally designated 16, is located within the chamber defined by the walls 12 and 14 and is connected to a shaft (not shown) in a manner well known in the art.

The rotor 16 has plural apices, generally designated 18 (only one of which is shown), and at each apex 18 the seal assembly, generally designated 20, is located.

Figure 1:
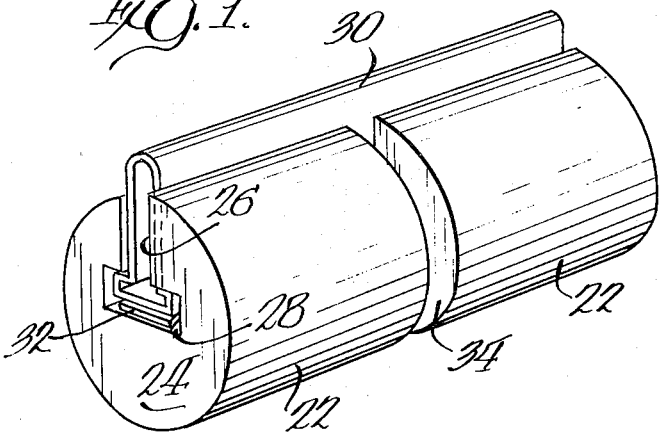
FIG. 1 is a perspective view of the seal assembly made according to the invention.

Referring particularly to FIG. 1, the seal assembly 20 is defined by two bolts 22 which are slightly spaced as illustrated, each bolt 22 having a cylindrical outer surface, although other configurations can be employed if desired. The ends 24 of each bolt 22 remote from the other bolt 22 are adapted to sealingly engage respective ones of the side walls 14, as illustrated in FIG. 3. In this connection, the combined length of the two bolts 22 is only somewhat less than the width of the rotor 16, as is apparent from FIG. 3. This construction provides for maximum support of a seal.

Each bolt 22 is provided with an upwardly opening, inverted, T-shaped slot 26. Stated another way, each slot 26 includes an enlarged lower portion 28 which is adapted to place limitations on radial movement of the apex seal as will be seen.

Received within the slots 26 in both of the bolts 22 is an elongated apex seal 30. The seal 30 also is of T-shaped cross section, and is dimensioned so that once fully received in the slots 26 in the bolts 22, it cannot escape therefrom in a radial direction. However, it is to be specifically noted that some radial movement is permitted under the influence of the usual biasing spring 32 for the usual purposes.

Turning now to FIGS. 2 and 3, the facing ends 34 of the bolts 22 include facing, threaded bores 36 for receipt of opposite ends of a helical spring 38. The spring 38 serves to both connect the bolts 22 together as an assembly, and bias the bolts 22 away from one another into firm engagement with the respective side walls 14. In this connection, the arrangement is chosen so that when the assembly is not installed in an engine, the distance between the faces 24 will be somewhat greater than the width of the rotor 16 so that some compression of the spring 38 will occur upon assembly. The amount of compression is chosen to provide the desired degree of biasing.

If desired, additional bores 40 in each of the bolts 22 may be provided for slidable receipt of a pilot pin 42.

To preclude the seal 30 from exiting the assembly of the bolts 22 axially, means are provided for precluding substantial axial relative movement between the bolts and the seal. In the preferred form of the embodiment, such means take on the form of a projection 44 (FIGS. 2 and 3) located so as to be between the bolts 22. Thus, lateral movement of the seal relative to the bolts 22 is limited by reason of engagement with the projection 44 with the end 34 of one or the other of the bolts 22.

The projection 44 may be formed by staking as the last operation forming the assembly. Alternately, it may be prelocated on the seal 30 so as to be movable through the enlarged portion 28 of the slot 26 before the spring 32 is installed, but after the bolts 22 have been assembled on the spring 38.

It should be observed that the use of the T-shaped slot 26 is only one of several possible constructions for preventing undesirable radial movement of the seal 30. Any configuration that will retain the seal 30 while allowing such radial movement as may be necessary to effect sealing engagement between the seal and the wall 12 for all positions of the rotor 16 can be employed.

From the foregoing, it will be appreciated that the seal assembly made according to the invention provides a number of advantages over those heretofore employed. For example, the seal can be mechanically assembled and packaged at a location remote from the engine assembly line, thereby minimizing the possibility that individual parts will be forgotten during assembly. Moreover, assembly of the rotor on the line can take place in less time, with the result that assembly costs are reduced and reliability of the engine improved. Finally, service work in the field can be performed by relatively untrained mechanics with a greater degree of reliability.

It will also be recognized that rotor construction is simplified in that it need only be provided with a through bore and a slot at each apex. Such a machining operation is less complicated than the present practice of providing a slot and shallow blind bores on opposite sides of the rotor for receipt of the bolts.

What is claimed is:

1. An apex seal assembly for rotary engines comprising a pair of spaced bolts, each adapted to engage a respective side wall of a rotor containing chamber of a rotary engine, each of said bolts having a generally radially extending slot therein, each said slot including an enlarged seal-retaining portion;

resilient means interposed between and interconnecting said bolts and adapted to urge said bolts away from each other when installed in a rotary engine into engagement with a corresponding side wall;

an apex seal received in the slots of both of said bolts, and said seal having an enlarged section within the enlarged seal-retaining portion of each of said slots; and means for precluding substantial lateral relative movement between said bolts and said seal.

2. The apex seal assembly of claim 1 wherein said precluding means comprises a projection on a side surface of said seal and located between said bolts to engage a respective end thereof.

3. An apex seal assembly according to claim 1 wherein said resilient means comprises a helix having its ends threaded into respective bores in said bolts.

4. An apex seal assembly according to claim 1 wherein the sum of the lengths of said bolts is only somewhat less than the width of the rotor with which said seal assembly is to be used.

5. An apex seal assembly according to claim 1 further including a pilot pin interconnecting said bolts.

* * * * *